United States Patent [19]

Allen

[11] Patent Number: 4,823,424

[45] Date of Patent: Apr. 25, 1989

[54] PAINT BRUSH CLEANING FUNNEL

[75] Inventor: Dixon L. Allen, Smithfield, Utah

[73] Assignee: Stephen J. Thatcher, Logan, Utah

[21] Appl. No.: 95,765

[22] Filed: Sep. 14, 1987

[51] Int. Cl.[4] ..... B08B 3/04

[52] U.S. Cl. ..... 15/104.92; 15/142; 134/182; 239/590.5

[58] Field of Search ..... 134/117, 182, 198, 201; 15/104.92, 142; 239/589, 590, 590.5, 597, 602

[56] References Cited

U.S. PATENT DOCUMENTS

| | | | |
|---|---|---|---|
| 577,362 | 2/1897 | Ettlinger | 239/602 |
| 1,233,417 | 7/1917 | Stephan | 239/590 X |
| 1,285,948 | 11/1918 | Cook | 15/142 X |
| 2,684,690 | 7/1954 | Lee | 239/590.5 X |
| 2,827,647 | 3/1958 | Speer | 15/142 X |
| 4,688,720 | 8/1987 | MacDonald et al. | 239/597 X |

FOREIGN PATENT DOCUMENTS

| | | | |
|---|---|---|---|
| 874562 | 4/1953 | Fed. Rep. of Germany | 239/590.5 |
| 88192 | 11/1966 | France | 239/597 |

*Primary Examiner*—Philip R. Coe

*Attorney, Agent, or Firm*—M. Ralph Shaffer

[57] ABSTRACT

A paint brush cleaning funnel, and combination including the same, wherein such funnel comprises a threaded liquid-inlet end, and outwardly flared hollow funnel portion, and a brush-tip-receiving hollow intermediate portion adjoining the inlet end with the funnel portion. The cross-section of the interior of the flared funnel portion, relative to its traverse dimension, resembles a slot or rectangle in the sense of the transverse length of the slot being longer than the width-wise dimension thereof. A paint brush is easily inserted in the funnel portion with the bristles thereof facing the liquid inlet end of the device. Water or other liquid coming through the inlet end operates to clean the bristles. The intermediate portion uniquely receives the bristles and allows these to expand moderately in the presence of the onrush of liquid. The funnel is large enough at its trailing end so that water or other liquid can be conveniently discharge without interference from the brush handle. A preferred form of the invention includes a series of interior teeth provided the funnel portion for paint brush cleaning purposes.

5 Claims, 1 Drawing Sheet

PAINT BRUSH CLEANING FUNNEL

FIELD OF THE INVENTION

The present invention relates to paint brush cleaning equipment and, more particularly, to a paint brush cleaning funnel and, permissibly in combination therewith, a pressurized liquid delivery hose coupled to the funnel and also and exterior paint brush for removable disposition within the funnel for cleaning purposes.

BACKGROUND OF INVENTION AND BRIEF DESCRIPTION OF PRIOR ART

For artisans, professional painters, and do-it-yourself property owners, there is the ever-present problem of refinishing or simply painting a variety of surfaces. While paint rollers and other devices are used with increasing frequency, for a variety of tasks, still the common paint brush having a bristle-end must necessarily be frequently employed, this for a variety of tasks. Whether the user employs water-base or oil-base paints, by way of example, there is the ever-present problem of cleaning the brush after use. This is a decided chore, oftentimes requiring repeated dispersion of the appropriate liquid through the brush, shaking out the brush, and so forth. It would of course be very advantageous to shorten the cleaning procedure for paint brushes and to make it more convenient and less messy for the user.

BRIEF DESCRIPTION OF PRESENT INVENTION

The fundamental inventive concept herein resides in the provision of a paint brush cleaning funnel. The same includes a threaded liquid-inlet end, and outwardly flared hollow funnel portion having a longitudinal axis, and also a brush-tip-receiving hollow intermediate portion adjoining the inlet end with the funnel for receiving the brush-tip or bristle end of a brush to be cleaned. The hollow intermediate portion of the device is preferably convex outwardly so as to provide an increased area for spreading out of the bristle tips while the brush is being cleaned; yet, the end of the brush tip as well as an upper portion of the bristles will be constrained, reasonably, so that undue spreading apart of the bristles during the cleaning process is not chanced. The flared funnel portion of the cleaning funnel has a longitudinal axis, and an interior opening that is flared outwardly in funnel-fashion, with the interior of the funnel preferably being provided with a multiplicity of cleaning teeth. These teeth will be for the purpose of cleaning the composite exterior bristle surfaces of the brush, such surfaces frequently being coated with semi-hardened paint material. The teeth of the flared interior of the funnel peripherally extend within the interior of such funnel so as to effect cleaning purposes not only for the sides but also for the edges of the bristle portion of the brush. The teeth are preferably disposed in successive rows that are staggered as to tooth positionment so that essentially the entire outer bristle surfaces of the bristle portion of the brush may be cleaned in an advantageous manner.

In combination, there is the provision of a pressured fluid supply joined to the inlet portion of the brush cleaning funnel as above described, and exterior brush being releasably disposed within the funnel for cleaning purposes. Accordingly, in operation, the oncoming fluid operates not only to clean the interior of the bristle portion of the brush but also the outer, essentially planer exterior surfaces of the bristled portion of such brush.

OBJECTS

Accordingly, a principal object of the present invention is to provide an new and improved brush cleaning device.

A further object of the invention is to provide a brush cleaning device wherein the same takes the form of a brush cleaning funnel, the latter having a fluid inlet opening, and intermediate portion, and also an outwardly flared funnel the transverse cross-sectional inner dimension of which is slot-like, that is, longer in transverse length than in transverse width.

An additional object is to provide a paint brush cleaning funnel wherein the interior of the funnel portion of the device is toothed, whereby to provide a series of teeth for cleaning the outer exterior surfaces of the bristle portion of such brush.

A further object is to provide a hollow paint brush cleaning device wherein the flared funnel portion thereof is constructed and arranged for aiding in cleaning of the brush, yet providing sufficient volumetric outflow proximate the end of a flared portion of such device so as not to unduly interfere with or contact the handle of the brush being cleaned.

The features of the present invention which are believed to be novel are set forth with particularity in the appended claims. The present invention, both as to its organization and manner of operation, together with further objects and advantages thereof, may be best understood be reference to the following description, taken in conjunction with the accompanying drawings in which:

DETAILED DESCRIPTION OF PREFERRED EMBODIMENTS

Figure 1:
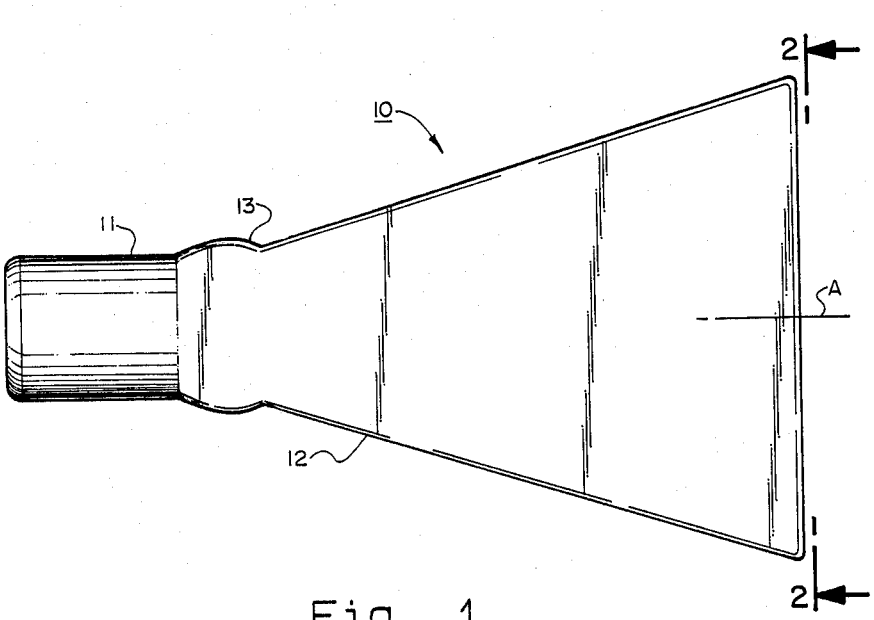
FIG. 1 is top plan of a paint brush cleaning device incorporating the basic features of the present invention.
Figure 2:
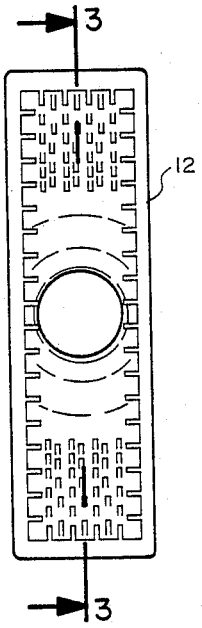
FIG. 2 is a right end view of the device of FIG. 1 and is taken along the line 2—2 therein.
Figure 3:
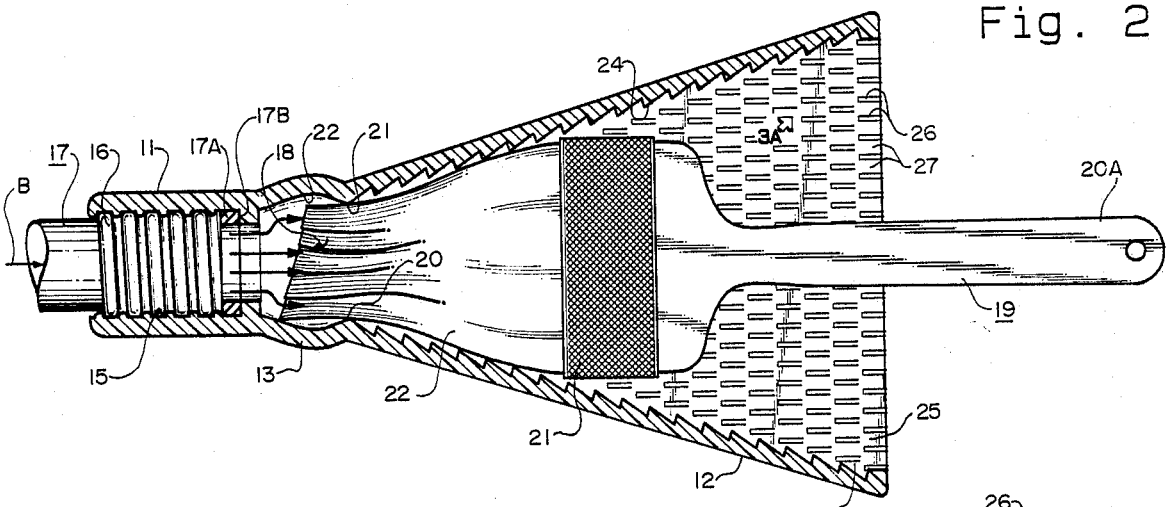
FIG. 3 is a transverse cross-section taken along the line 3—3 in FIG. 2 and showing a brush as being disposed within the interior of the device for cleaning purposes.

In FIGS. 1–3 the paint brush cleaning funnel 10 of the invention is shown to include an internally threaded liquid inlet end 11, and outwardly flared funnel of portion 12 and, joining and integral with the two, intermediate portion 13. The liquid inlet portion 11 is preferably inwardly threaded at 15 to accommodate the male portion 16 of a standard garden hose 17, by way of example. Of course there may be all types of couplings accommodating connection of a liquid supply to liquid inlet end 11. A gasket 17A may be disposed against shoulder 17B of the liquid end or liquid emittance port at 11. Intermediate portion 13 is preferably convex outwardly so as to provide for the insertion of the bristle end 18 of paint brush 19. The bristle end may be constrained at constriction 20 formed by the interior edge 21 of the device if desired; in any event, there will be sufficient space within the interior 22 of the intermediate portion so that the bristle ends can spread outwardly as liquid is introduced from the liquid supply at 17.

Brush 19, in addition to having the bristle in 18, will be provided with the usual handle 20 and, connected thereto, bristle holder 21 and standard bristle multiplicity 22 in standard paint-brush design.

Funnel portion 12 is flared outwardly as indicated, includes a longitudinal axis A, and, in direction transverse to such longitudinal axis, includes an opening of progressively reduced size as the one proceeds from the right end of the funnel portion in the direction to the left, such opening being slot-like or less in transverse width than in transverse length dimension. This is to accommodate ease of insertion of the brush for cleaning purposes and also to permit fluid flow in the direction of arrow B so that the fluid flow will not be proximate the handle 20A of the brush. Likewise, the slope and character of the funnel portion allows for proximate disposition of the inner surfaces of the funnel portion relative to the edges of the bristle portion of the brush.

Figure 3A:
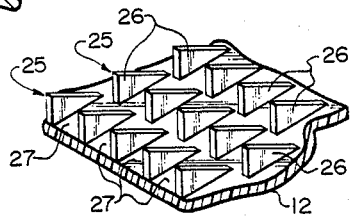
FIG. 3A is an enlarged fragmentary perspective view of a representative tooth portion of the interior of the painters funnel of FIG. 3 and is taken along the arrow 3A in the in FIG. 3.
Figure 4:
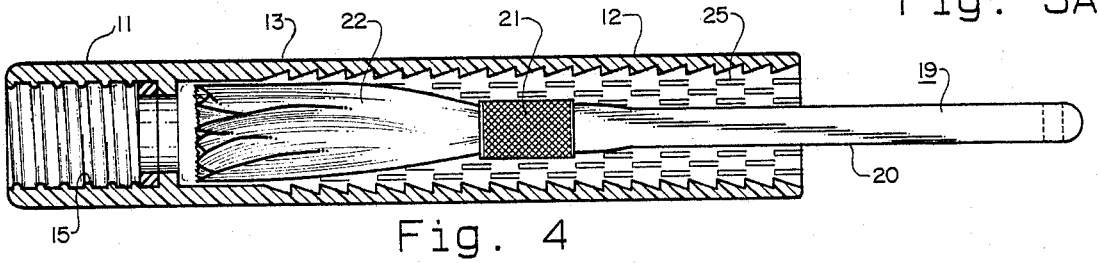
FIG. 4 is a longitudinal vertical section of the cleaning device of FIG. 3, showing a paint brush being cleaned, therein

Most importantly, the inner peripheral surface 24 of the funnel portion will have a series of teeth 26. These are preferably arranged in rows with the teeth of adjacent rows being staggered as seen in FIG. 3A. It is noted that the short dimension or cutting edges of the teeth face forwardly whereas the long rearwardly-declined edges of the teeth face rearwardly. This is for the purposes of permitting the teeth to cut into any semi-hardened or dried paint of the brush along the exterior surfaces of the bristled portion thereof; however, the long sloping nature of the individual teeth relative to their posterior surfaces permits for ease of insertion of the brush to the cleaning disposition shown in FIG. 3. When the brush is withdrawn, either after cleaning or during the cleaning process, slight withdrawal agitating movements will cause a cutting phenomenon of the teeth relative to the sides of the bristle portion of the brush. Thus, in FIGS. 2 and 3, adjacent rows 25 of teeth 26, spaced apart by spaces 27, are arranged such that the teeth relative to the adjacent rows are staggered. These teeth will be of the order of 1/16th of an inch in thickness or less, and may be spaced apart a distance of perhaps 3/32 of an inch. Preferably the teeth will be disposed completely about the interior of the funnel portion of the device, this so that a maximum cleaning effect can be obtained. The series of parallel arrows in FIG. 3 illustrate fluid flow through the brush when the pressure relative to inlet hose 17 is applied to liquid carried by the same.

The cleaning funnel of the invention may be thought of as a subcombination of the combination including the liquid delivery hose and the releasable brush.

In operation, the user connects a hose to the device as shown, places the brush in the manner indicated, and turns on liquid-pressure to clean the brush. The brush can be agitated back and forth within the funnel device to permit the teeth to operate as above described to permit the funnel teeth to operate as above described.

This invention has been described in its presently contemplated best mode, and it is clear that it is susceptible to numerous modifications, modes and embodiments within the ability of those skilled in the are and without the exercise of the inventive faculty. Accordingly, the scope of this invention is defined by the scope of the following claims.

What is claimed is:

1. A paint brush cleaning funnel comprising a threaded liquid-inlet end, an outwardly flared funnel portion provided an unobstructed fluid exit end and having a longitudinal axis and an interior opening, and a brush-tip-receiving hollow intermediate portion disposed between and integral with said inlet end and said funnel portion, a representative transverse cross-section of said flared funnel portion opening, transverse to the said longitudinal axis of said flared funnel portion, being essentially rectangular, greater in length than in width, and of uniform width, to and through said fluid exit end.

2. The cleaning funnel of claim 1 wherein said intermediate portion is outwardly circumferentially convex, whereby to permit moderate lateral expansion of the bristle-tip of an external brush to be cleaned, when water under pressure is introduced in said liquid inlet end.

3. The cleaning funnel of claim 1 wherein said flared funnel portion is provided with a series of transversely inwardly directed teeth means for cleaning exterior surfaces of the bristle portion of an external paint brush.

4. A paint brush cleaning funnel comprising a threaded liquid-inlet end, an outwardly flared funnel portion having a longitudinal axis and an interior opening, and a brush-tip-receiving hollow intermediate portion disposed between and integral with said inlet end and said funnel portion, a representative transverse cross-section of said flared funnel portion opening, transverse to the said longitudinal axis of said flared funnel portion, being greater in length than in width, wherein said flared funnel portion is provided with a series of transversely inwardly directed teeth means for cleaning exterior surfaces of the bristle portion of an external paint brush, and wherein said teeth means include a series of teeth having cutting edges essentially facing forwardly toward said intermediate portion.

5. The structure of claim 4 wherein said teeth are mutually spaced and arranged in tooth-staggered rows.

* * * * *